US007449835B2

(12) United States Patent
Trushell

(10) Patent No.: US 7,449,835 B2
(45) Date of Patent: Nov. 11, 2008

(54) CONTAMINANT GETTER ON UV REFLECTIVE BASE COAT IN FLUORESCENT LAMPS

(75) Inventor: Charles Trushell, Manhattan, KS (US)

(73) Assignee: Koninklijke Philips Electronics, Eindhoven (NL)

( * ) Notice: Subject to any disclaimer, the term of this patent is extended or adjusted under 35 U.S.C. 154(b) by 331 days.

(21) Appl. No.: 10/538,567

(22) PCT Filed: Dec. 3, 2003

(86) PCT No.: PCT/IB03/05776

§ 371 (c)(1),
(2), (4) Date: Jun. 15, 2005

(87) PCT Pub. No.: WO2004/055860

PCT Pub. Date: Jul. 1, 2004

(65) Prior Publication Data

US 2006/0113886 A1 Jun. 1, 2006

(51) Int. Cl.
*H01J 17/24* (2006.01)

(52) U.S. Cl. ..... 313/549; 313/547; 313/553; 313/562; 313/489

(58) Field of Classification Search ..... 313/489, 313/485, 484, 479, 635, 639, 642, 549, 553, 313/554, 555, 556, 557, 558, 559, 560, 561, 313/562, 580, 486, 472, 638, 547
See application file for complete search history.

(56) References Cited

U.S. PATENT DOCUMENTS

| | | | | |
|---|---|---|---|---|
| 2,748,306 A | | 5/1956 | Bjorkman | |
| 3,875,455 A | * | 4/1975 | Kaduk et al. | 313/489 |
| 4,451,757 A | | 5/1984 | Lagos | |
| 5,552,665 A | * | 9/1996 | Trushell | 313/489 |
| 5,604,396 A | | 2/1997 | Watanabe et al. | |

FOREIGN PATENT DOCUMENTS

| | | |
|---|---|---|
| JP | 56138852 | 10/1981 |
| JP | 61027055 | 2/1986 |
| JP | 05013048 | 1/1993 |
| JP | 05025474 | 2/1993 |
| WO | WO0030151 A1 | 5/2000 |
| WO | WO0156350 A2 | 8/2001 |

* cited by examiner

*Primary Examiner*—Nimeshkumar Patel
*Assistant Examiner*—Thomas A Hollweg

(57) ABSTRACT

An electric lamp is provided having a luminescent layer on the lamp envelope that produces visible light when impinged by ultraviolet radiation generated within the lamp. An undercoat for the electric lamp increases the luminous efficacy of the lamp. The undercoat includes a particulate non-fluorescent material derived from a sintered mixture of an aluminum oxide material with a contiguous layer of getter material which reacts with contaminants present in the lamp. The getter material is an alkaline earth metal borate material or mixtures thereof.

17 Claims, 1 Drawing Sheet

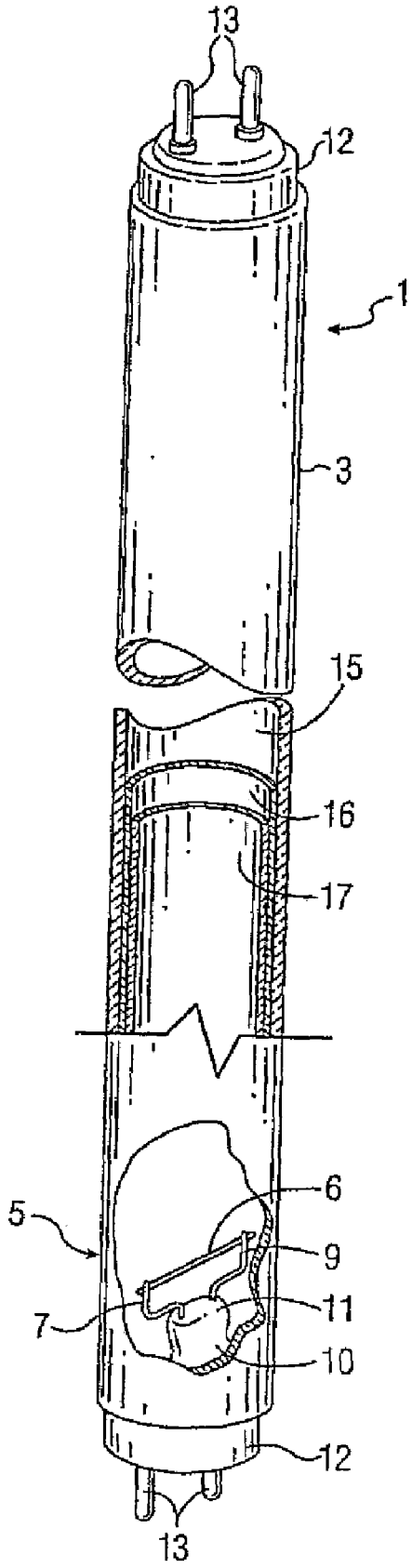
13
12
1
3
15
16
17
6
5
9
11
7
10
12
13

CONTAMINANT GETTER ON UV REFLECTIVE BASE COAT IN FLUORESCENT LAMPS

This application relates to co-pending patent application Ser. No. 10/017,360 filed Dec. 14, 2001 of Charles Trushell and Liviu Magean titled "CONTAMINANT GETTER ON UV REFLECTIVE BASE COAT IN FLUORESCENT LAMPS" and assigned to the same assignee as in the present application.

This invention relates to low-pressure mercury vapor lamps, more commonly known as fluorescent lamps, having a lamp envelope with phosphor coating, and more particularly, to such lamps in which the amount of contaminants introduced into the lamp during manufacture has been reduced during lamp operation. This has the effect of reducing mercury consumption, improving maintained light output and improving arc stability at the time of lamp ignition.

Low-pressure mercury vapor lamps, more commonly known as fluorescent lamps, have a lamp envelope with a filling of mercury and rare gas to maintain a gas discharge during operation. The radiation emitted by the gas discharge is mostly in the ultraviolet (UV) region of the spectrum, with only a small portion in the visible spectrum. The inner surface of the lamp envelope has a luminescent coating, often a blend of phosphors, which emits visible light when impinged by the ultraviolet radiation.

There is an increase in the use of fluorescent lamps because of reduced consumption of electricity. To further reduce electricity consumption, there is a drive to increase efficiency of fluorescent lamps, referred to as luminous efficacy which is a measure of the useful light output in relation to the energy input to the lamp, in lumens per watt (LPW).

U.S. Pat. No. 5,552,665 of Charles Trushell, the inventor in the present application, relates to an electric lamp having a luminescent layer on the lamp envelope which produces visible light when impinged by ultraviolet radiation generated within the lamp, and wherein an undercoat for the luminescent layer is employed. The disclosure of said patent is hereby incorporated by this reference thereto. Such an undercoat is now a common feature of modern fluorescent lamps, and is an oxidic, particulate base coat layer of non-fluorescent material, preferably an aluminum oxide, underlying the light-giving phosphor. Such an undercoat or base-coat is intended to economically increase light output, simplify the manufacturing process, improve the maintenance of light output, and reduce mercury consumption by the glass bulb. Typically, such layers are composed of very small particles with consequently large surface areas. Unfortunately, it has been found that the large surface of the particulate base-coat combined with the propensity of aluminum oxide to adsorb gaseous molecules results in larger than normal amounts of contaminants being introduced into the lamp interior during manufacture. For example, water and carbon dioxide are common, volatile, fluorescent lamp contaminants, the amounts of which are increased as a result of the large surface area of the undercoat. One effect of the increased amount of these contaminants is to increase the duration of arc instability immediately after lamp ignition.

It is also known to coat the phosphor layer contained in a fluorescent lamp. For example:

Tamura, Japanese Patent Application No. 03179238 (Abstract)), describes a procedure wherein MgO is mixed with a phosphor at 0.01-1.0% and used to form a layer as a step in the manufacture of a fluorescent lamp in order to getter $CO_2$ and CO impurities which exist after the lamp is manufactured.

Watanabe et al, U.S. Pat. No. 5,604,396, describes a method wherein an alcoholic solution of a metal alkoxide (wherein the metal may be any of numerous metals including magnesium) is added to an aqueous suspension of a phosphor, which is to be coated by the alkoxide. Upon evaporation of the alcohol, the alkoxide is converted to a hydroxide and homogeneously precipitated on the surface of the phosphor in a sol-gel process. After removal of the water, the hydroxide-coated phosphor is fired at a high temperature; however, no specific benefits are claimed for coating the phosphor with the metal alkoxide. Moreover, coating the phosphor with metal alkoxide or metal oxide does not eliminate or mitigate the increase in duration of the arc instability in the lamp when an oxidic base-coat such as alumina is used.

In said co-pending application Ser. No. 10/017,360 filed Dec. 14, 2001 of Charles Trushell and Liviu Magean titled "CONTAMINANT GETTER ON UV REFLECTIVE BASE COAT IN FLUORESCENT LAMPS" referred to above, the need in the art for a means of reducing the amount of contaminants and for eliminating or at least mitigating the increase in duration of arc instability to which the contaminants contribute in a fluorescent lamp is addressed by providing an undercoat layer comprising a particulate non-fluorescent material derived from a sintered mixture of an aluminum oxide material and, as a getter material which is capable of irreversible reaction with contaminants present in the lamp, a particulate oxidic material, preferably an aluminum oxide having on its surface, preferably as a contiguous layer, an oxide of an alkaline earth metal or zinc formed in situ during the lehring (sintering) process via reaction, for example, through thermal decomposition, of an alkaline earth metal oxide precursor material or zinc oxide precursor material or mixture thereof which reacts to form an alkaline earth metal oxide or zinc oxide or mixture thereof.

There is a continued need in the art for fluorescent lamps in which said undercoat layer comprising a particulate non-fluorescent material derived from a sintered mixture of an aluminum oxide material and alternative getter materials which are capable of irreversible reaction with contaminants present in the lamp.

An object of the invention is to provide a fluorescent lamp in which the amount of contaminants is reduced and in which the arc instability to which the contaminants contribute is substantially eliminated.

The present invention accomplishes the above and other objects by providing an electric lamp that includes:

an envelope having an inner surface;

means within the lamp envelope for generating ultraviolet radiation;

a layer of a luminescent material adjacent to the inner surface of the lamp envelope for generating visible light when impinged by said ultraviolet radiation; and an undercoat layer between said inner surface of said lamp envelope and said layer of luminescent material, for reflecting ultraviolet radiation which has passed through said layer of luminescent material back into said luminescent material for increasing the visible light output of said luminescent material, said undercoat layer comprising a particulate non-fluorescent material derived from a sintered mixture of an aluminum oxide material and an alkaline earth metal borate getter material which is capable of irreversible reaction with contaminants present in the lamp.

In one embodiment of the invention, said undercoat layer comprises a particulate oxidic material, preferably an aluminum oxide having on its surface, preferably as a contiguous layer, a borate of an alkaline earth metal formed in situ during the lehring (sintering) process via reaction, for example, through thermal decomposition, of an alkaline earth metal borate precursor material or mixture thereof which reacts to form an alkaline earth metal borate or mixture thereof on said oxidic base-coat material.

In another embodiment, the undercoat layer comprises alumina having on its surface a contiguous layer of alkaline earth metal borate formed in situ during the lehring (sintering) process as a result of thermal decomposition of an alkaline earth metal pyroborate precursor. In this way advantage is taken of the large surface area of the oxidic base-coat material, in part responsible for the arc instability, to act as the site for said irreversible reaction.

Suitable getter materials are borates of alkaline earth metals and include magnesium, calcium, strontium, and barium borates, and mixtures thereof, formed in situ during the lehring (sintering) process by a precursor compound or mixtures of such compounds which are introduced as soluble compounds into an aqueous suspension of the aluminum oxide base-coat material. Mixtures forming magnesium pyroborates are particularly preferred for use as a getter compound for purposes of this invention.

Suitable precursor materials may be any alkaline earth metal compound or mixture thereof that reacts during the lehring step to form an alkaline earth borate or mixture of such materials on the surface of the oxidic base-coat material. Illustrative of such precursor materials suitable for use herein are magnesium, calcium, strontium, and barium citrates, acetates, nitrates, etc. The preferred getter materials are pyroborates of magnesium, calcium, strontium, and barium, and mixtures thereof, which are formed, for example, by addition of boric acid or ammonium borate and calcium nitrate introduced as soluble compounds into the suspension of the oxidic base coat material.

The FIGURE is a perspective view of a fluorescent lamp, partly in cross-section, partly broken away, having an undercoat with getter material according to the invention. The invention will be better understood with reference to the details of specific embodiments that follow.

With reference to the FIGURE, there is illustrated a low-pressure mercury vapor discharge or fluorescent lamp 1 with an elongated outer envelope, or bulb 3. The lamp includes a conventional electrode structure 5 at each end which includes a filament 6 supported in in-lead wires 7 and 9 which extend through a glass press seal 11 in a mount stem 10. The electrode structure 5 is not the essence of the present invention, and other structures may be used for lamp operation to generate and maintain a discharge in the discharge space. For example, a coil positioned outside the discharge space may be used to generate an alternating magnetic field in the discharge space for generating and maintaining the discharge.

Returning to the illustrative lamp 1 of the FIGURE, the leads 7,9 are connected to pin-shaped contacts 13 of their respective bases 12 fixed at opposite ends of the lamp 1. The discharge-sustaining filling includes an inert gas such as argon, or a mixture of argon and other gases, at a low pressure in combination with a small quantity of mercury to sustain an arc discharge during lamp operation. The inner surface 15 of the outer envelope 3 is provided with an undercoat 16 of aluminum oxide as a non-fluorescent material coated with a contiguous layer of an alkaline earth borate formed as follows:

A mixture of boric acid or ammonium borate is added to a solution of calcium nitrate. Preferably, the borate-producing moiety (boric acid or ammonium borate) and the alkaline earth metal nitrate (calcium nitrate) are present in a molar ratio such that about 4 moles of boron are present for each mole of alkaline earth metal. This favors the production of alkaline earth metal pyroborates which are believed to be the borate form that is particularly beneficial in the elimination of arc instability according to the invention. The individual borate salts formed are believed to melt and thermally decompose to form predominantly pyroborates during sintering. For this reason, mixtures of alkaline earth metal nitrates or other soluble salts may be employed with good advantage to achieve a desired composition while obtaining a sufficiently low thermal decomposition temperature. The alkaline earth pyroborate formed from the proportions indicated above represents from about 1 to about 3 wt. % of borate based on the weight of the aluminum oxide as getter material to remove contaminants from the lamp.

Once the base-coat layer 16 is sintered, the resulting borate getter material(s) become quite water-insoluble. This permits the application of an aqueous suspension of phosphors to form a phosphor layer 17 directly over the non-fluorescent base-coat. After drying, this layer is sintered again before it is made into a lamp.

A phosphor coating 17 is disposed over the undercoat 16. Both coatings extend the full length of the bulb, completely circumferentially around the bulb inner wall.

The undercoat layer may be cast from organic solvent or water based suspensions to which various components may be added without substantially changing the various advantages of the non-fluorescent oxidic undercoat. The suspension is applied to the interior of a clean fluorescent tube in a manner known to the art and is then lehred or sintered, also in a manner well known in the art.

The bulb is then lehred and finished into a lamp in the manner known in the art.

To further reduce mercury consumption, the glass mount stems and press seals may also be coated with the aluminum oxide undercoat layer to reduce mercury bound to the glass mount stems and press seals.

This invention recognizes the discovery that alkaline earth metal borates, particularly when incorporated in aluminum oxide reflective undercoats via thermal decomposition of precursor materials during lehring, are effective to reduce or eliminate contaminants introduced into the lamp during manufacture and substantially reduces the duration of or eliminates arc instability immediately after lamp ignition.

The invention was demonstrated in a series of 32T8 fluorescent bulbs, 4 feet in length and 1 inch in diameter using about 0.5-1.0 grams of commercially available aluminum oxide containing amounts of calcium nitrate and boric acid calculated to produce about 1-3% calcium pyroborate based on the weight of the aluminum oxide.

Representative lamps were produced in which the undercoat layer 16 comprises particulate aluminum oxide, i.e. alumina having on its surface a contiguous layer of an alkaline earth metal borate or phosphate. The alumina was suspended in a water-based solution to which an amount of boric acid and barium nitrate is added, and flushed down the lamp tube or envelope 3 to flow over the envelope inner surface 15 until it exits from the other end. The solution was dried in a drying chamber. A phosphor coat 17 was applied in a similar fashion and sintered or baked for a period of time.

Several other lamps were made using the same procedure but without any borate additives or borate precursor additives. Only the alumina UV reflecting base-coats were applied in these lamps since the arc in such a lamp design is known to be particularly unstable once ignited. All of the lamps were produced and stored at room temperature unignited for 3 months when they were examined for the relative arc instability. The results showed that in lamps of this invention, arc instability after lamp ignition was virtually eliminated. In contrast, lamps that were not so processed and treated exhibited a substantial period of arc instability after lamp ignition.

The phosphors suitable for use in this invention may vary according to the properties desired in the final lamp. For example, for a 4100° K fluorescent lamp where the color temperature is about 4100° K, i.e., in degree Kelvin, the phosphor coat 17 is typically comprised of a mixture of three phosphors. The phosphor mixture typically consists of a blue-emitting barium magnesium aluminate (BAM) activated by Eu, a red-emitting yttrium Oxide (YOX) activated by Eu, i.e., $Y_2O_3$:Eu; and typically a green-emitting lanthanum phosphate (LAP) activated by cerium and terbium.

The three-phosphor mixture in the 4100° K lamp allows the lamp 1 to have reduced mercury consumption in conjunction with the alumina undercoat 16 which shields the glass envelope 3 from mercury.

Since very thin layers of the getter compounds are effective in gettering the contaminants in question, the optics of the bulk material are not effectively altered. The invention has been found to be useful in all UV reflective base coats in fluorescent lamps.

While not wishing to be bound by any theory, experimental data indicates that contamination above a certain threshold level in the finished lamp results in a dramatically increased duration of arc instability in conventional lamps and that decreasing the contamination below this threshold dramatically reduces, and in most cases, virtually eliminates the duration of the arc instability. Thus the solution according to this invention is the reduction of impurities responsible for the contamination by taking advantage of the large surface area provided by the UV reflecting base-coat. It is believed that most of the water present in the lamp will be reacted with borate getter material during manufacture of the lamp. As a result once the lamp is manufactured, the amount of water physisorbed on the particulate aluminum oxide will be reduced to an amount that is incapable of contributing to arc instability.

While the present invention has been described in particular detail, it should also be appreciated that numerous modifications are possible within the intended spirit and scope of the invention. In interpreting the appended claims it should be understood that where and if it appears:

a) the word "comprising" does not exclude the presence of elements other than those listed in a claim;
b) the word "consisting" excludes the presence of elements other than those listed in a claim;
c) the word "a" or "an" preceding an element does not exclude the presence of a plurality of such elements; and
d) any reference signs in the claims do not limit their scope.

The invention claimed is:

1. An electric lamp, comprising:
a) a lamp envelope having an inner surface;
b) means within the lamp envelope for generating ultraviolet radiation;
c) a layer of a luminescent material adjacent the inner surface of the lamp envelope for generating visible light when impinged by said ultraviolet radiation; and
d) a base-coat layer, between said inner surface of said lamp envelope and said layer of luminescent material, for reflecting ultraviolet radiation which has passed through said layer of luminescent material back into said luminescent material for increasing the visible light output of said luminescent material, said base-coat layer comprising a particulate non-fluorescent oxidic material with a getter material on its surface which reacts with contaminants present in the lamp, said getter material comprising an alkaline earth metal pyroborate.

2. The lamp according to claim 1, wherein said getter material is formed upon thermal decomposition of a getter precursor material during lehring.

3. The lamp according to claim 1, wherein said base-coat layer comprises a particulate aluminum oxide having a contiguous layer of a borate of an alkaline earth metal or mixtures thereof formed by exposing the particulate aluminum oxide during the lehring process to an effective amount of a precursor material of an alkaline earth metal borate getter compound.

4. The lamp as claimed in claim 3, wherein said base-coat layer is sintered just prior to the envelope being sealed during manufacture of said lamp.

5. The lamp as claimed in claim 3, wherein said getter material includes a borate of an alkaline earth metal selected from the group consisting of magnesium, calcium, strontium, barium, and mixtures thereof.

6. The lamp as claimed in claim 5, wherein said sintered mixture is derived from a soluble precursor compound of an alkaline earth metal borate or mixtures thereof in an aqueous suspension of aluminum oxide.

7. The lamp according to claim 1, wherein said means for generating ultraviolet radiation is disposed within said lamp envelope, said lamp envelope including a filling of an ionizable material and a rare gas and a pair of discharge electrodes between which a discharge takes place during lamp operation.

8. The lamp according to claim 1, wherein said means for generating ultraviolet radiation comprises a filling of an ionizable material and a rare gas within said lamp envelope and a pair of discharge electrodes each adjacent to a respective sealed end of said discharge vessel.

9. An electric lamp, comprising:
a) a lamp envelope having an inner surface;
b) means within the lamp envelope for generating ultraviolet radiation;
c) a layer of a luminescent material adjacent the inner surface of the lamp envelope for generating visible light when impinged by said ultraviolet radiation; and
d) a base-coat layer, between said inner surface of said lamp envelope and said layer of luminescent material, for reflecting ultraviolet radiation which has passed through said layer of luminescent material back into said luminescent material for increasing the visible light output of said luminescent material, said base-coat layer comprising a particulate non-fluorescent oxidic material with a getter material on its surface which reacts with contaminants present in the lamp, said getter material comprising an alkaline earth metal borate or mixtures thereof, wherein said base-coat layer comprises a particulate aluminum oxide having a contiguous layer of the alkaline earth metal borate or mixtures thereof formed by exposing the particulate aluminum oxide during the lehring process to an effective amount of a precursor material of an alkaline earth metal borate getter compound, and wherein said getter material comprises an alkaline earth metal pyroborate.

10. The lamp as claimed in claim 9, wherein said layer of luminescent material comprises a halophosphate phosphor.

11. A low pressure mercury vapor fluorescent lamp, comprising:
a) a tubular, light transmissive lamp envelope having opposing sealed ends and an inner tubular surface;
b) a filling of mercury and a rare gas;
c) a pair of discharge electrodes each arranged at a respective sealed end of said lamp envelope;

d) means for connecting said discharge electrodes to a source of electric potential outside of said lamp envelope, whereby during lamp operation a gas discharge is maintained between said discharge electrodes, wherein said gas discharge emits ultraviolet radiation;

e) a first layer disposed on said inner tubular surface of said lamp envelope, wherein said first layer is a light transmissive and ultraviolet radiation reflecting layer, said first layer comprising a sintered mixture of an aluminum oxide material and a getter material which reacts with contaminants present in the lamp, said getter material comprising an alkaline earth metal pyroborate; and f) a second layer of luminescent material disposed on said first layer.

12. The lamp as claimed in claim 11, wherein said first layer comprises a particulate aluminum oxide having a contiguous layer of an alkaline earth metal borate or mixtures thereof formed by exposing the particulate aluminum oxide material during the lehring process to an effective amount of an alkaline earth metal borate precursor compound.

13. The lamp as claimed in claim 11, wherein said first layer is sintered just prior to the envelope being sealed during manufacture of said lamp.

14. The lamp as claimed in claim 13, wherein said alkaline earth metal is selected from the group consisting of magnesium, calcium, strontium, barium, and mixtures thereof.

15. The lamp as claimed in claim 14, wherein said sintered mixture is derived from a soluble borate precursor material of said alkaline earth metal or mixture thereof in an aqueous suspension of aluminum oxide.

16. An electric lamp, comprising:

a) a lamp envelope having an inner surface;

b) means within the lamp envelope for generating ultraviolet radiation;

c) a layer of a luminescent material adjacent the inner surface of the lamp envelope for generating visible light when impinged by said ultraviolet radiation; and d) a base-coat layer, between said inner surface of said lamp envelope and said layer of luminescent material, for reflecting ultraviolet radiation which has passed through said layer of luminescent material back into said luminescent material for increasing the visible light output of said luminescent material, said base-coat layer comprising a particulate non-fluorescent oxidic material with a getter material on its surface, said getter material comprising an alkaline earth metal pyroborate effective to react with contaminants present in the lamp to the extent that arc instability after ignition of the lamp is substantially eliminated.

17. The electric lamp as claimed in claim 16, wherein said base-coat is formed from material comprising about 0.5 to about 1.0 grams of aluminum oxide containing an amount of calcium nitrate and boric acid calculated to produce as said getter material about 1 to about 3% calcium pyroborate based on the weight of the aluminum oxide.

* * * * *